US007513681B2

(12) United States Patent
Kingsford

(10) Patent No.: US 7,513,681 B2
(45) Date of Patent: Apr. 7, 2009

(54) STATIC MIXING DEVICE

(75) Inventor: Kenji A. Kingsford, DeVore, CA (US)

(73) Assignee: Saint-Gobain Performance Plastic Corporation, Wayne, NJ (US)

( * ) Notice: Subject to any disclaimer, the term of this patent is extended or adjusted under 35 U.S.C. 154(b) by 524 days.

(21) Appl. No.: 11/188,145

(22) Filed: Jul. 22, 2005
(Under 37 CFR 1.47)

(65) Prior Publication Data

US 2007/0019503 A1 Jan. 25, 2007

(51) Int. Cl.
*B01F 5/00* (2006.01)

(52) U.S. Cl. ..... 366/340; 366/181.5; 366/336; 137/599.01; 137/599.03

(58) Field of Classification Search ..... 366/336, 366/340, 181.5; 137/599.01, 599.03
See application file for complete search history.

(56) References Cited

U.S. PATENT DOCUMENTS 2,740,616 A * 4/1956 Walden ..... 366/336
2,777,467 A * 1/1957 Powell et al. ..... 138/37
4,043,539 A * 8/1977 Gilmer et al. ..... 366/340
4,340,311 A 7/1982 Crandal
5,938,328 A * 8/1999 Pinto et al. ..... 366/174.1

FOREIGN PATENT DOCUMENTS

| | | | |
|---|---|---|---|
| DE | 401 477 | C | 9/1924 |
| DE | 197 43 957 | A1 | 7/1999 |
| NL | 45 004 | C | 2/1939 |
| WO | WO 88/03052 | A | 5/1988 |

* cited by examiner

*Primary Examiner*—David L Sorkin
(74) *Attorney, Agent, or Firm*—Larson Newman Abel & Polansky LLP; Chi Suk Kim

(57) ABSTRACT

Mixing devices comprise a mixing element having a body with a fluid inlet port, and a fluid outlet port that is separated from the fluid inlet port. Fluid outlet passages extend through a body wall section defining the fluid inlet port, and fluid inlet passages extend through a body wall section defining the fluid outlet port. The body includes an outside surface having a reduced diameter section, and the fluid inlet and outlet passages are positioned axially along the reduced diameter section. The mixing element is statically disposed within an internal chamber of a housing, and an annular volume is defined between an inside surface of the internal chamber and the mixing element reduced diameter section to facilitate passage and mixing of fluid within the annular volume. The mixing element total inlet area is approximately equal to its total outlet area to minimize unwanted pressure drop.

21 Claims, 3 Drawing Sheets

STATIC MIXING DEVICE

FIELD OF THE INVENTION

The present invention relates generally to mixing devices used for combing two or more streams of fluid or gas together to provide a single mixed flow output and, more particularly, to a static mixing device that that provides such mixed flow output in a construction that is compact and efficient.

BACKGROUND OF THE INVENTION

Many processes are know in the art that require the mixing together of two of more fluid or gas streams to provide a mixed output stream. These processes can be used in any number of applications. A particular application where the mixing together of fluid streams is used is the semiconductor manufacturing industry. For example, during the process of making semiconductors, it is necessary to use a fluid stream that comprises a mixed flow of two or more different independent fluids.

Conventionally, the combining or mixing together of two of more fluid or gas streams is achieved by using a dynamic mixing device, e.g., a device that takes the entering fluid or gas streams and then mixes them together using a moving or dynamic element within the device. The dynamic mixing element can be provided, e.g., in the form of a rotating turbine blade. The dynamic mixing element forces the interaction of the two or more individual fluids or gases within the device to produce a resulting mixed output stream.

While this is one method of forming a mixed output, it is one that can involve a number of moving parts that can fail or otherwise have a limited service life. Additionally, the use of such dynamic mixing device comprising a moving element requires an energy input, which has associated therewith a certain energy cost. A further issue associated with the use of such dynamic mixing device relates to its packaging size, which to ensure a good degree of mixing is relative large. For example, for a dynamic mixing device comprising a turbine blade mixing element, the device must be constructed having a relatively long mixing cavity to ensure good mixing.

Additionally, when used in such applications requiring that a high degree of fluid purity be maintained, it is desired that the mixing device be configured having a minimal internal hold up volume, e.g., having as close to a fully-swept internal structure as possible, to ensure that little if any fluid is retained within the device. Further, when any of the fluids being mixed within the device are highly corrosive, such as acids and the likes used in semiconductor processing, it is desired that the mixing device be constructed both having as few as possible leak paths and be constructed from materials that will not degrade or cause the corrosive process fluid to become contaminated.

Accordingly, it is therefore desired that a mixing device be constructed in a manner that will provide a desired degree of fluid mixing that does not depend on the use of a dynamic mixing element. It is also desired that a mixing device be constructed in a manner that is relatively compact and space efficient to promote and facilitate easy use in fitment in an existing or new fluid handling process system. It is further desired that such mixing element be constructed in a manner having a minimum internal hold up volume, that produces a minimum pressure loss for fluid passed therethrough, and for certain applications be constructed from materials that will not degrade or otherwise adversely impact, e.g., introduce contaminates into, the purity of the fluid being passed therethrough.

SUMMARY OF THE INVENTION

Mixing devices of this invention comprise a mixing element that includes a body having a fluid inlet port disposed therein that extending axially a distance inwardly into the body from a fluid inlet port opening positioned at a body first axial end. The body includes a fluid outlet port disposed therein that extends axially a distance inwardly into the body from a fluid outlet port opening positioned at a body second axial end that is opposite the first axial end. The body includes an inner wall that separates the fluid inlet port from the fluid outlet port.

The body includes at least one fluid outlet passage extending radially through a wall of the body defining the fluid inlet port, and at least one fluid inlet passage extending radially through a wall of the body defining the fluid outlet port. In a preferred embodiment, the body includes a plurality of fluid outlet and fluid inlet passages and the fluid inlet and outlet passages are not axially aligned relative to one another. In a preferred embodiment, the combined surface area of the fluid outlet passages is approximately the same as that of the fluid inlet port, and the combined surface area of the fluid inlet passages is approximately the same as that of the fluid outlet port.

The body further comprises an outside surface comprising a reduced diameter section that is interposed between a first flanged end section positioned adjacent the first axial end and a second flanged end section positioned adjacent the second axial end. In a preferred embodiment, the reduced diameter section includes an outwardly curved portion that is positioned between the fluid inlet and fluid outlet passages. In a preferred embodiment, the mixing element body is of a one-piece construction.

Mixing devices of this invention include a housing that comprises an internal chamber for accommodating the mixing element therein. The housing can comprise a two-piece construction formed by coupling members, and an annular volume is defined between an inside surface of the housing internal chamber and the mixing element reduced diameter section. In a preferred embodiment, the annular volume has a surface area that is approximately the same as that of the at least one fluid outlet passage.

Mixing devices of this invention constructed in this manner generates a fluid mixing vortex motion that provides a desired degree of fluid mixing without the need for a dynamic mixing element, i.e., using a static mixing element. Additionally, such mixing devices have compact packaging to facilitate space efficient fitment and use in an existing or new fluid handling process system. Further, such mixing devices of this invention are constructed having a minimum internal hold up volume, are constructed to provide a minimum pressure drop therethrough, and can be constructed from materials that will not degrade or otherwise adversely impact the purity of fluids being passed therethrough.

DESCRIPTION OF THE DRAWINGS

These and other features and advantages of the present invention will become appreciated as the same becomes better understood with reference to the specification, claims and drawings wherein:

DETAILED DESCRIPTION OF THE INVENTION

Mixing devices, constructed according to principles of this invention, are configured to provide a mixed output stream of fluids or gases in a manner that does not involve the use of a dynamic element, and is packaged in a manner that is space efficient. Further, mixing devices of this invention are constructed having a minimal pressure drop therethrough to reduce any unwanted pressure affect when placed into a process flow system. Further, mixing devices of this invention are constructed to have an internally swept volume with a zero or minimal internal hold up volume, and can be formed from materials that facilitate use with high purity process fluids such as corrosive liquids and the like without introducing unwanted contamination therein. Specifically, mixing devices of this invention can be formed from wetted elements made from chemically inert materials resistant to corrosive, abrasive, and caustic process fluids, are not formed from metal, and are constructed without the use of dynamic seals.

Figure 1:
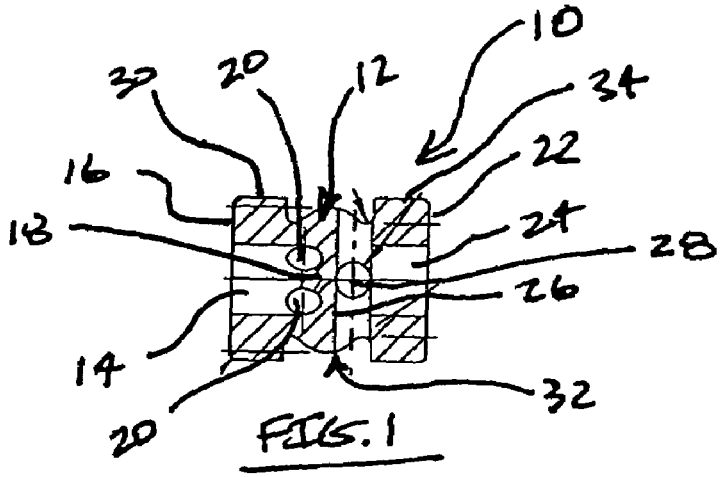
FIG. 1 is a cross-sectional side view of a mixing device taken along section 1-1 in FIG. 2.
Figure 2:
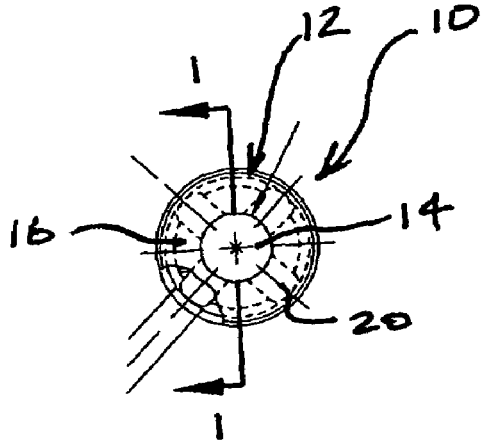
FIG. 2 is a front view of a first end of the mixing device of FIG. 1.
Figure 3:
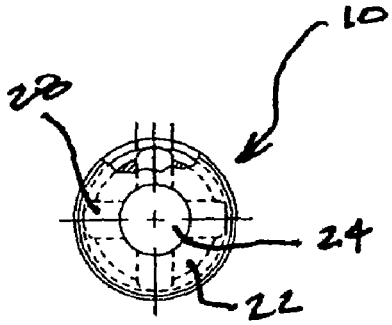
FIG. 3 is a front view of a second end of the mixing device of FIG. 1.

FIGS. 1 to 3 illustrates a mixing device 10 of this invention comprising a mixing body 12 having a generally cylindrical outer configuration, and that includes a fluid inlet port 14 that extends axially inwardly a distance from a first axial end 16 of the body. As best shown in FIG. 1, the fluid inlet port 14 extends a distance within the body from an opening at the first axial end 16 to a closed end 18 positioned within the body. The fluid inlet port 14 is in fluid flow communication with a number of fluid outlet passages 20 that extend radially through the mixing body 12 from the fluid inlet port 14 to an outer surface of the body.

In an example embodiment, the fluid inlet port 14 is sized having a diameter that is generally the same as that of an upstream fluid flow stream that it is connected to or mounted therein for the purpose of minimizing or eliminating any pressure loss resulting from the fluid entering the mixing device body 12. It is also desired that the total surface area of all of the fluid outlet passages 20 be closely matched to the surface area of the fluid inlet port 14. In a preferred embodiment, the total surface area of the fluid outlet ports 20 is the same as that of the fluid inlet port 18, again for the purpose of reducing or minimizing unwanted fluid pressure loss through the mixing device.

The number of fluid outlet passages 20 can vary depending on the fluid mixing application. As best shown in FIG. 2, in a preferred embodiment, the mixing body 12 is constructed having four fluid outlet passages 20 that are positioned at 45 degree equal-distant locations through the body 1. As noted above, the exact number of the fluid outlet passages 20 can vary. However, it is generally desired that the fluid outlet passages be positioned at equal-distant locations through the mixing body for reasons that will be better discussed below. Again, in a preferred embodiment, each fluid outlet passage 20 is sized so that the total surface area of all four fluid outlet passages 20 is the same as the surface area of the fluid inlet port 14. Thus, the fluid outlet passages are sized having a diameter, and the mixing body is configured having a radial thickness, to closely match the surface area of the fluid inlet port.

In an example embodiment, configured for use within a particular fluid transport system for mixing together two or more different fluids, the fluid inlet port 14 has a diameter of approximately 0.25 inches, and the four fluid outlet passages 20 each have a diameter of approximately 0.125 inches. The axial depth of the fluid inlet port, and the wall thickness of the mixing body 12 adjacent the fluid outlet passages, are both sized to provide a mixing body having equal annular surface areas through both the fluid inlet port and the combined four fluid outlet passages 20.

The mixing body 12 includes a second axial end 22 that is positioned opposite the first axial end 16, and that includes a fluid outlet port 24 extending a distance axially therein. The fluid outlet port 24 extends from a second end closed end 26 to the second axial end 22. In an example embodiment, the fluid outlet port 24 has a diameter that is sized generally the same as that of the upstream fluid flow stream that it is connected to or mounted to the mixing body to again minimize or eliminate any pressure loss resulting from the fluid passing through the mixing body 12.

The mixing body includes a number of fluid inlet passages 28 that are in fluid flow communication with the fluid outlet port 24, and that extend radially through the mixing body 12. As described above with respect to the fluid inlet port and fluid outlet passages, it is desired that the total surface area of all of the fluid inlet passages 24 be closely matched to the surface area of the fluid outlet port. In a preferred embodiment, the total surface area of the fluid inlet ports 28 is the same as that of the fluid outlet port 24. This is done for the purpose of reducing or minimizing unwanted fluid pressure loss through the mixing device.

The number of fluid inlet passages 24 can vary depending on the fluid mixing application. As best shown in FIG. 3, in a preferred embodiment, the mixing body is constructed having four fluid inlet passages 28 that are positioned at 45 degree equal-distant locations through the body 12. As noted above, the number of the fluid inlet passages can vary. However, it is generally desired that the fluid inlet passages be positioned at equal-distant locations through the mixing body.

More specifically, for the purpose of maximizing fluid mixture efficiency and creating a fluid mixing vortex motion, it is desired that the placement locations of the fluid outlet and inlet passages along the mixing body be axially offset or staggered from one another. The staggering or offset positioning of the fluid outlet and inlet passages operates to further facilitate the mixing together of the different fluids entering the mixing device by avoiding a straight-line flow passage therebetween. In the preferred embodiment described above, comprising the four above-noted fluid outlet and fluid inlet passages, the fluid inlet passages are positioned along the mixing body axially staggered or offset from the fluid outlet passages by approximately 12.5 degrees. In a preferred embodiment, the fluid inlet passages are positioned axially between two adjacent fluid outlet passages, again for the purpose of avoiding a straight line flow path therebetween.

In a preferred embodiment, like the fluid outlet passages 20, each fluid inlet passage 24 is sized so that the total surface area of all four fluid inlet passages 24 is the same as the surface area of the fluid outlet port 24. Thus, the fluid inlet passages are sized having a diameter, and the mixing body is configured having a radial thickness, to match the surface area of the fluid outlet port.

In an example embodiment, configured for use within a particular fluid transport system for mixing together two or more different fluids, the fluid outlet port 24 has a diameter of approximately 0.25 inches, and the four fluid inlet passages 28 each have a diameter of approximately 0.125 inches. The axial depth of the fluid outlet port, and the wall thickness of the mixing body 12 adjacent the fluid inlet passages, provides a mixing body having a fluid outlet port 24 annular surface area that is equal to that of the combined four fluid inlet passages 28.

As noted briefly above, the mixing body 12 has a generally cylindrical exterior surface configuration. Referring to FIG. 1, moving along the exterior surface from the first axial end 16, the mixing body 12 includes a radially projecting first flanged section 30. The first flanged section 30 extends axially a distance to a reduced diameter section 32 that is located adjacent an axial midpoint of the body. The reduced diameter section 32 extends axially a distance to a second flanged section 34.

The reduced diameter section 32 generally has a diameter that is less than that of both the first and second flanged sections 30 and 32, and the fluid outlet and fluid inlet passages are both disposed through the mixing body along the exterior surface of the mixing body defined by the reduced diameter section 32. In a preferred embodiment, the reduced diameter section 32 is configured having a convex or outwardly-curved surface that includes a radiused transition at both of its axial ends adjacent the first and second flanged sections. In a preferred embodiment, the fluid outlet passages and fluid inlet passages are located adjacent the radiused transition portions at each end of the outwardly-curved surface.

In an example embodiment, the reduced diameter section 32 is specially configured to provide an annular fluid flow passage, as defined between the reduced diameter section and an adjacent surrounding wall surface of a mixing device enclosure, that both facilitates the turbulent flow of fluid passing therethrough and that is sized having a surface area that is closely matched to that of the fluid inlet port 14, the fluid outlet port 24, the sum of the fluid outlet passages 20, and the sum of the fluid inlet passages 28. The reduced diameter section 32 is sized in this manner again to minimize unwanted pressure loss of fluid being passed through the mixing body 12.

In a preferred embodiment, the reduced diameter section 32 is configured having an outwardly-curved surface, and the fluid outlet and inlet passages are positioned along the transition portions, for the purpose of reducing the diameter of the annular fluid flow passage as the fluid is passed from the fluid outlet passages 20 to the fluid inlet passages 28, thereby causing the fluid flow to be accelerated along the exterior surface of the mixing body to create turbulent fluid flow that promotes thorough fluid mixing.

In a preferred embodiment, where the total axial length of the mixing body as measured between the first and second ends is approximately 0.7 inches, the mixing body reduced diameter section has a radius of curvature of approximately 0.25 inches, and the radiused transitions each have a radius of curvature of approximately 0.03 inches. In such preferred embodiment, the first and second flanged sections 30 and 34 each have an outside diameter of approximately 0.57 inches, and the reduced diameter section 32 has a maximum outside diameter of approximately 0.51 inches as measured at the crest of the outwardly-curved portion.

In an example embodiment, such as that illustrated in FIGS. 1 to 3, the mixing device 10 is configured with a mixing body 12 having a symmetrical configuration. The use of a mixing body having a symmetric configuration may be desired for purposes of easing assembly of the device into a mixing housing, enclosure or the like, to prevent the possibly of assembling the device in the housing in an incorrect orientation. It is to be understood, however, that the mixing body need not be constructed having symmetric configuration, and that mixing devices of this invention can be configured having a nonsymmetrical configuration if such is desired.

Additionally, while the fluid inlet and outlet passages for the mixing body have been described and illustrated as having a generally round or circular configuration, it is to be understood that such fluid inlet and outlet passages can be configured having an oval or other non-circular configuration. Thus, the exact shape of the fluid inlet and outlet passages for mixing devices within the scope of this invention are understood to vary.

A feature of the mixing body is that it include inside cavities or chambers, e.g., in fluid flow communication with the fluid inlet port 14 and the fluid outlet port 24 that are substantially fully swept by the fluid being passed therethough. Specifically, the inside cavities or chambers within the mixing body are configured so that there are no pockets or the like that are outside of the flow path of the fluid being passed therethrough, wherein the presence of such pockets is undesirable as it would provide a location within the mixing device where fluid could be held up and not pass out of the device. The mixing body includes fully swept inside cavities or chambers, which eliminates the presence of such unwanted hold up volumes so that the volume of fluid being passed into the device is also fully passed therefrom.

Mixing devices of this invention are used in conjunction with a housing or an enclosure that is sized and configured to facilitate the passage of a desired fluid streams to and from the mixing device in a manner that enables the device to provide a thorough degree of fluid mixing as the fluid is passed therethrough. The exact configurations of the mixing device housings or enclosures useful with the mixing device can and will vary depending on the particular end use application. However, generally speaking, each housing or enclosure includes an internal chamber that is sized and configured to accommodate placement of the mixing device body therein. The internal chamber is sized having a diameter that provides a desired annular space between the chamber and the reduced diameter section of the body where bulk of the fluid mixing takes place. The housing or enclosure includes a fluid inlet that is in fluid communication with the fluid inlet of the mixing body, and a fluid outlet that is in fluid communication with the fluid outlet of the mixing body.

Figure 4:
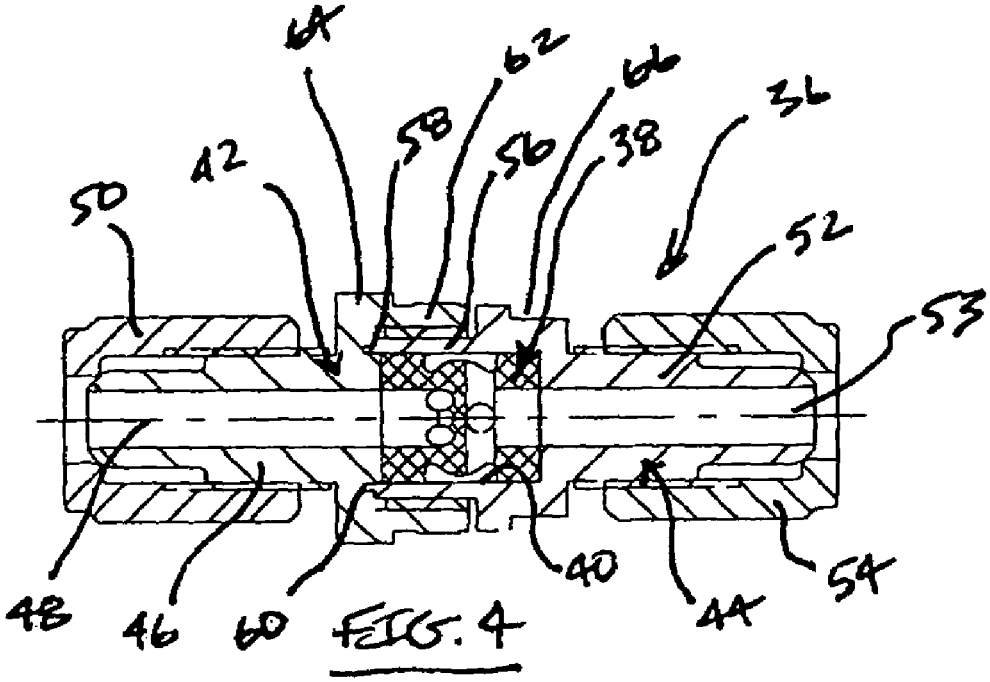
FIG. 4 is a cross-sectional side view of a mixing device of FIGS. 1 to 3 disposed within a single-flow housing taken through section 4-4 of FIG. 5.
Figure 5:
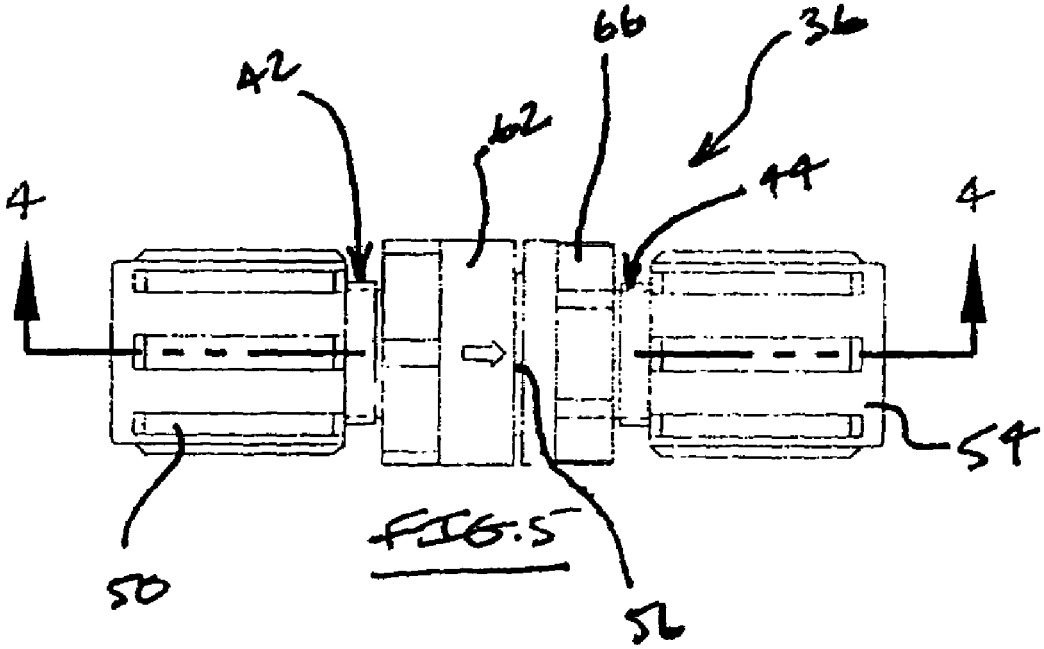
FIG. 5 is a side view of the single-flow housing of FIG. 4.

FIGS. 4 and 5 illustrate an example embodiment mixer device housing or enclosure 36 that is generally configured to accommodate the mixing device body 38 therein within an internal chamber 40. In this example embodiment, the housing 36 comprises a two-part assembly including a first housing member 42 that is connected with a second housing member 44, and the internal chamber is formed between the two connected together housing members.

In such example embodiment, the first housing member 42 includes a generally cylindrical body 46 hat extends axially and that defines an internal inlet fluid port 48 therein. The body 46 has an outside surface that is sized and shaped to facilitate connection with a fluid transport conduit or device (not shown). In an example embodiment, at least a section of the body outside surface is threaded to permit attachment of an annular threaded connector 50 therewith, wherein together the body and the connector are configured to accommodate placement of a fluid conduit member, e.g., in the form of a hose or tube, therebetween. Constructed in this manner, the first housing member 42 is capable of being placed into fluid flow connection with a fluid conduit by placing an end of the fluid conduit over an end of the body 46 and tightening the threaded connector 50 onto the body to trap the fluid conduit therebetween by an interference fit.

The second housing member 44, like the first housing member, also includes a generally cylindrical body 52 that extends axially and that defines an internal outlet fluid port 53 therein. The body 46 has an outside surface that is sized and shaped to facilitate connection with a fluid transport conduit or device (not shown). In an example embodiment, at least a section of the body outside surface is threaded to permit attachment of an annular threaded connector 54 therewith, wherein together the body and the connector are configured to accommodate placement of a fluid conduit member, e.g., in the form of a hose or tube, therebetween. Constructed in this manner, the second housing member 44 is capable of being placed into fluid flow connection with a fluid conduit by placing an end of the fluid conduit over an end of the body 52 and tightening the threaded connector 55 onto the body to trap the fluid conduit therebetween by an interference fit.

The first and second housing members each include ends, opposite the respective housing member ends connected with the threaded connectors, that having cooperating surface features specially configured to provide the internal chamber 40 for accommodating the mixing device body 38. In an example embodiment, one of the housing members includes a cylindrical wall structure that projects axially outwardly therefrom sized to accommodate the mixing device body and that further provides a leak-tight seal with the other one of the housing members. In a preferred embodiment, the second housing member 44 includes the cylindrical wall structure 56 that projects axially outwardly therefrom a length that slightly exceeds the length of the mixing body.

The wall structure 56 is sized having an inside diameter that closely matches an outside diameter of the mixing body first and second flanged sections 30 and 34, to enable the mixing body to be slidably disposed therein while also minimizing any bypass fluid flow therebetween. In a preferred embodiment, the wall structure 56 includes a tongue 58 that is positioned circumferentially around an end of the wall structure, and that projects outwardly a distance therefrom. The tongue 58 is sized to fit within a groove 60 that is disposed in an adjacent end of the first member housing 42. In a preferred embodiment, the tongue is sized having a radial thickness that is slightly larger than that of the groove to provide a tight interference tongue-in-groove fit therebetween to ensure a leak-tight seal between the first and second housing members.

In such preferred embodiment, the first housing member 42 includes a collar 62 that projects axially outwardly a distance from its end adjacent the second housing member wall structure 56, and that is sized to fit concentrically around an outside surface of the wall structure. In a preferred embodiment, the collar 62 includes an inside surface, and the wall structure includes an outside surface, that are each threaded to accommodate threaded engagement with one another to couple the first and second housing members together.

In an example embodiment, the first and second housing members can be each configured having an outside surface feature that facilitates threadably engaging and tightening the two members together. In a preferred embodiment, the first housing member 42 includes an enlarged diameter section 64 adjacent the collar that is shaped having a hexagonal configuration to permit grasping and rotating by a conventional hand tool such as an open or closed-end wrench. Similarly, in a preferred embodiment, the second housing member 44 includes an enlarged diameter section 66 adjacent the wall section 56 that is shaped having a hexagonal configuration.

In a preferred embodiment, the mixing device housing 36 comprises an inlet fluid port 48 that is sized having the same diameter as the mixing body fluid inlet port, and comprises an outlet fluid port 53 that is sized having the same diameter as the mixing body fluid outlet port, for the purpose reducing pressure drop of fluid being passed through the housing and the mixing body. Further, the wall structure 56 is sized having an inside diameter that provides an annular fluid flow or fluid mixing passage, as defined between the reduced diameter section the wall structure, to both create turbulent fluid flow therein and minimize unwanted pressure drop of fluid being passed through the housing and mixing device.

The housing 36 described above and illustrated in FIGS. 4 and 5 is useful in those applications where the two or more fluid streams being mixed together are capable of being provided in a single fluid flow stream upstream from the housing. In such example embodiment, the two or more fluids entering the housing are combined at some other point upstream of the housing. Alternatively, the mixing device housing or enclosure can be configured to itself facilitate combining of two or more different fluid flow streams for mixing together.

Figure 6:
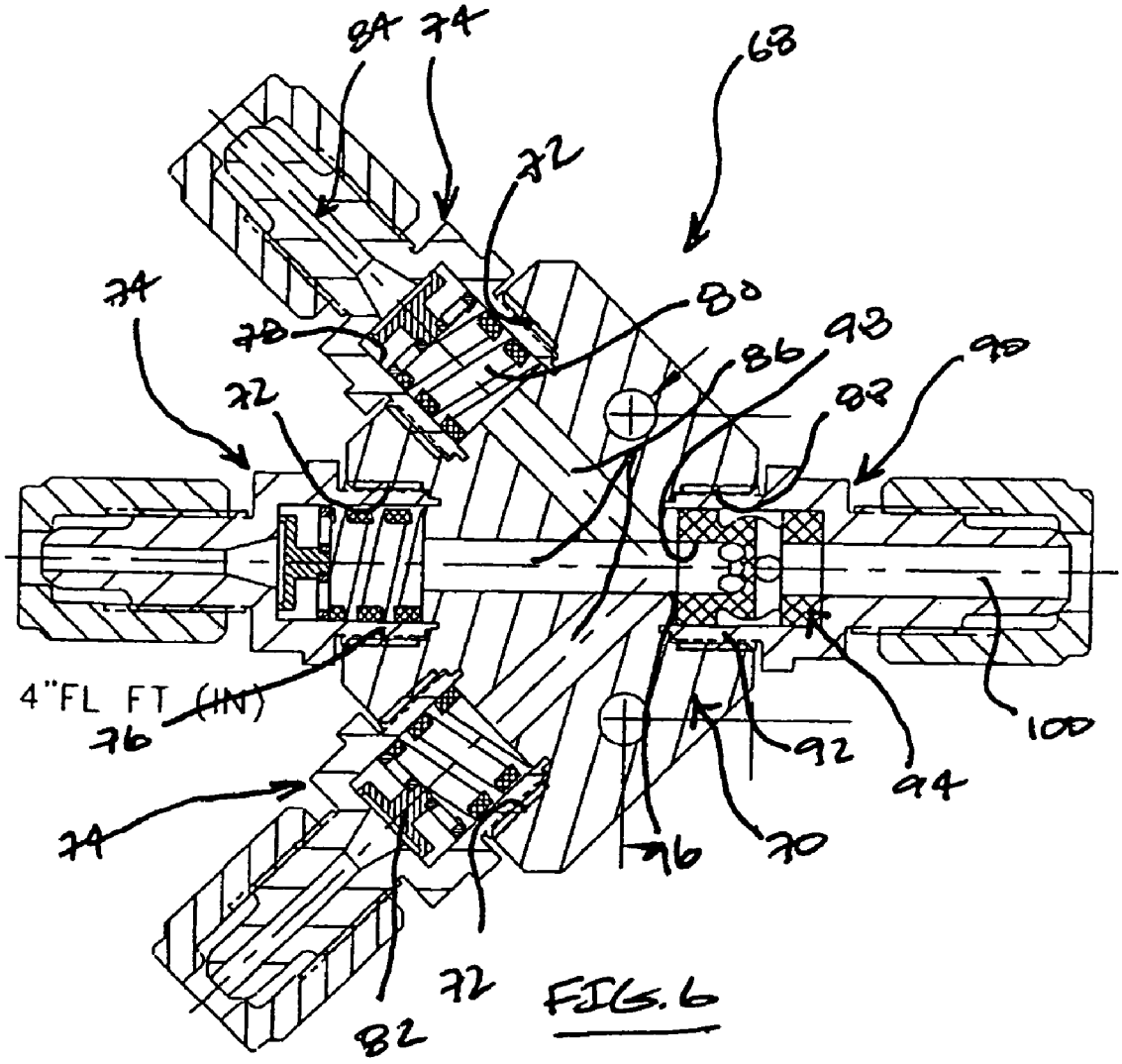
FIG. 6 is a cross-sectional side view of a mixing device of FIGS. 1 to 3 disposed within a multi-flow manifold housing.

FIG. 6 illustrates an example embodiment of a mixing device housing or enclosure 68 that is provided in the form of a combined mixing device housing and manifold for accommodating a number of different fluid inlet streams. In this particular embodiment, the housing 68 comprises a body 70 that is configured having three fluid inlet connection openings 72 that are each sized and shaped to accommodate coupling with a respective fluid inlet connection member 74. The type of fluid inlet connection member 74 that is used to facilitate transport of the different fluids to the body 70 can and will vary depending on the particular use application for the mixing device of this invention. For example, the fluid inlet connection members can be provided in the form of simple fluid transport conduits that include some upstream form of fluid flow control means. Alternatively, the fluid inlet connection members can be provided in the form of flow check valves to provide passage of fluid to the body 70 upon pressurizing the fluid in communication therewith to a threshold preset pressure.

In an example embodiment, the fluid inlet connection members 74 are each provide in the form of a fluid check valve. Wherein each fluid inlet connection member 74 comprises an outside surface configured similarly to that described above for the second housing member; namely, comprising a wall structure 76 extending axially therefrom that that defines an inner chamber 78. The wall structure includes a tongue projecting axially from its end that fits within a groove in the body connection opening 72 to provide a leak tight seal therebetween.

A spring 80 is disposed within the inner chamber 78 and extends axially from the opening 72 to a valve member 82 also disposed within the chamber. The valve member 82 projects axially away from the spring 80 and includes an end positioned over an outlet of a fluid passage 84 extending through the fluid inlet connection member. The spring 80 imposes a biasing force onto the valve member 82 to seal off and prevent the passage of fluid from the outlet until the fluid is pressurized to overcome such biasing force.

The body includes three inlet fluid ports 86 extending internally therethrough from each of the fluid inlet connection openings. Thus, fluid that passes through any one or more of the fluid inlet connection members 74 passes into the body through one or more of the inlet fluid ports 86. The body 70 includes a mixing device connection opening 88 that is sized and configured to accommodate attachment with a mixing device housing member 90. In an example embodiment, the fluid device housing 90 has inside and outside surface features configured similarly to that of the second housing member described above; namely, it includes a wall structure 92 that projects axially outwardly a distance therefrom and has an inside diameter that is sized and configured to accommodate the mixing device 94 therein. The wall structure includes a tongue projecting outwardly from its end that is disposed within a groove of the body opening 88 to provide a leak-tight seal therewith.

The body 70 includes a single outlet fluid port 96 that disposed downstream from and is in fluid flow communication with the inlet fluid ports 86. In a preferred embodiment, the outlet fluid port 96 is sized having the same diameter as that of the mixing body fluid inlet port 98 for the purpose of minimizing unwanted fluid pressure loss passing through the mixing device. Configured in this manner, fluid entering the body from any one of the fluid inlet connection members 74 pass into the body via the inlet fluid ports 86 and are directed to the mixing device via the body outlet fluid port 96 and is mixed by passage through the mixing body as described above. The mixed fluid exists the housing 68 via the fluid outlet port 100 that extends through the mixing device housing 90.

A feature of mixing devices of this invention is that they provide for the mixing together of fluids without the need for moving parts, i.e., by using a static mixing body. The mixing body is configured in a manner, that when disposed within the housing, provides a turbulent fluid flow condition that effectively and efficiently mixes together the fluid streams that are introduced. Further, the mixing device of this invention is specially design to provide such effective and efficient mixing in a manner that occupies minimal packaging space, thereby facilitating it use in many space sensitive process or fluid flow applications. Further still, mixing devices of this invention are specially constructed to provide such mixed fluid flow in a manner that minimizes unwanted fluid pressure drop by having a total inlet area that is equal to the total outlet area.

Materials used to construct the mixing body and mixing body housing of this invention can vary depending on intended use application. For non-critical applications, e.g., where the fluids being mixed are not an aggressive chemical and/or are not high purity, the mixing body and its housing can be formed from conventional materials known for making structurally rigid bodies such as polymeric materials and/or metallic materials. However, when used in other critical or sensitive applications, such as in semiconductor manufacturing, where aggressive chemicals and/or high-purity chemicals are used, it is desired that the mixing body and its housing be formed from a non-metallic chemically resistant material, such as a fluoropolymeric material.

Suitable fluoropolymeric materials include those selected from the group including of polytetrafluoroethylene (PTFE), fluorinated ethylene-propylene (FEP), perfluoroalkoxy fluorocarbon resin (PFA), polychlorotrifluoroethylene (PCTFE), ethylenechlorotrifluoroethylene copolymer (ECTFE), ethylene-tetrafluoroethylene copolymer (ETFE), polyvinylidene fluoride (PVDF), polyvinyl fluoride (PVF) and the like. A particularly preferred material useful for forming the mixing body is PTFE, and a particularly preferred material useful for forming the mixing body housing is PFA. The mixing body and/or the housing can be formed by molding or machining process. In an example, the mixing body is machined and the housing is molded. The housing illustrated in FIG. 6 is machined from PTFE.

Although limited embodiments of mixing devices of this invention have been specifically described and illustrated herein, many modifications and variations will be apparent to those skilled in the art. Accordingly, it is to be understood that, within the scope of the appended claims, mixing devices constructed according to principles of this invention may be embodied other than as specifically described herein.

What is claimed is:

1. A mixing element comprising:

a body having:

an outside surface comprising a reduced diameter section that is interposed between a first flanged end section positioned adjacent a first axial end and a second flanged end section positioned adjacent a second axial end opposite the first axial end;

a fluid inlet port disposed within the body and defined by a first wall portion, the fluid inlet port extending axially a distance inwardly into the body from a fluid inlet port opening positioned at the first axial end;

a fluid outlet port disposed within the body and defined by a second wall portion, the fluid outlet port extending axially a distance inwardly into the body from a fluid outlet port opening positioned at the second axial end, wherein the body includes an inner wall that separates the fluid inlet port from the fluid outlet port;

a single set of fluid outlet passages extending radially through the first wall portion, each of the fluid outlet passages extending substantially within a first plane perpendicular to a longitudinal axis of the body; and a single set of fluid inlet passages extending radially through the second wall portion, each of the fluid inlet passages extending substantially within a second plane perpendicular to the longitudinal axis.

2. The mixing element as recited in claim 1 wherein the set of fluid outlet passages are not axially aligned with the set of fluid inlet passages.

3. The mixing element as recited in claim 1 wherein the combined surface area of the set of fluid outlet passages is approximately the same as that of the fluid inlet port.

4. The mixing element as recited in claim 1 wherein the combined surface area of the set of fluid inlet passages is approximately the same as that of the fluid outlet port.

5. The mixing element as recited in claim 1 wherein the number of the fluid inlet passages is the same as the number of the fluid outlet passages.

6. The mixing element as recited in claim 1 wherein the reduced diameter section includes a radially extending convex portion when viewed from a cross-section extending parallel to a longitudinal axis of the body, the radially extending convex portion being in fluid communication with the fluid inlet and fluid outlet passages.

7. A housing comprising an internal chambers, the mixing element as recited in claim 1 disposed within the internal chamber, further comprising an annular volume defined between an inside surface of the internal chamber and the outer surface at the reduced diameter section, wherein the annular volume has a surface area that is approximately the same as that of the set of fluid outlet passages.

8. The mixing element as recited in claim 1 wherein the body is formed from a fluoropolymeric material.

9. The mixing element as recited in claim 1 wherein the body is a one-piece construction.

10. A fluid mixing device comprising:

a mixing element having a body that includes:

an outside surface comprising a reduced diameter section that is interposed between a first flanged end section positioned adjacent a first axial end and a second flanged end section positioned adjacent a second axial end opposite the first axial end;

a fluid inlet port extending axially a distance from the first axial end, the fluid inlet port defined by a first wall portion;

a fluid outlet port extending axially a distance from the second axial end, wherein the fluid inlet port does not extend to the fluid outlet port within the body, the fluid outlet port defined by a second wall portion;

a single set of fluid outlet passages extending radially through the first wall portion, each of the fluid outlet passages extending substantially within a first plane perpendicular to a longitudinal axis of the body; and a single set of fluid inlet passages extending radially through the second wall portion, each of the fluid inlet passages extending substantially within a second plane perpendicular to the longitudinal axis, wherein the set of fluid outlet passages and the set of fluid inlet passage are in fluid communication with the reduced diameter section of the outside surface of the body; and a housing that includes an inlet fluid port, an outlet fluid port, and an internal chamber interposed therebetween, wherein the mixing element is disposed within the internal chamber, and wherein an annular volume is defined between an inside surface of the internal chamber and the mixing element reduced diameter section.

11. The device as recited in claim 10 wherein the fluid outlet passages are not axially aligned with the fluid inlet passages.

12. The device as recited in claim 10 wherein the combined surface area of the fluid outlet passages is approximately the same as that of the fluid inlet port.

13. The device as recited in claim 10 wherein the combined surface area of the fluid inlet passages is approximately the same as that of the fluid outlet port.

14. The device as recited in claim 10 wherein the number of the fluid inlet passages is the same as the number of the fluid outlet passages.

15. The device as recited in claim 10 wherein the set of fluid inlet passages comprises four fluid inlet passages that are positioned radially along the body at 45 degree intervals from one another.

16. The device as recited in claim 10 wherein the reduced diameter section includes a radially extending convex portion when viewed from a cross-section extending parallel to an axis of the mixing element, the radially extending convex portion extending between the fluid inlet and fluid outlet passages.

17. The device as recited in claim 10 wherein the annular volume has a surface area that is approximately the same as that of the at least one fluid outlet passage.

18. The device as recited in claim 10 wherein the mixing element body is a one-piece construction.

19. The device as recited in claim 1 wherein each fluid inlet passage and each fluid outlet passage is in fluid communication with the outside surface proximal to the reduced diameter section.

20. A fluid mixing device comprising:

a housing that includes a fluid inlet, a fluid outlet, and an internal chamber interposed therebetween; and a mixing element disposed within the internal chamber and having a body that includes:

an outside surface comprising a reduced diameter section that is interposed between a first flanged end section positioned adjacent a first axial end and a second flanged end section positioned adjacent a second axial end opposite the first axial end, an annular volume defined between the reduced diameter section and the housing, the reduced diameter section including a radially extending convex portion when viewed from a cross-section extending parallel to a longitudinal axis of the mixing element;

a fluid inlet port extending axially a distance from the first axial end, the fluid inlet port defined by a first wall portion;

a fluid outlet port extending axially a distance from the second axial end, wherein the fluid inlet port does not extend to the fluid outlet port within the body, the fluid outlet port defined by a second wall portion;

a set of fluid outlet passages extending radially through the first wall portion, each of the fluid outlet passages extending substantially within a first plane perpendicular to the longitudinal axis; and a set of fluid inlet passages extending radially through the second wall portion, each of the fluid inlet passages extending substantially within a second plane perpendicular to the longitudinal axis, wherein the set of fluid outlet passages and the set of fluid inlet passage are in fluid communication with the reduced diameter section of the outside surface of the body.

21. A fluid mixing device as recited in claim 19 wherein the set of fluid outlet passages are not axially aligned with the set of fluid inlet passages.

* * * * *

UNITED STATES PATENT AND TRADEMARK OFFICE

CERTIFICATE OF CORRECTION

PATENT NO. : 7,513,681 B2
APPLICATION NO. : 11/188145
DATED : April 7, 2009
INVENTOR(S) : Kenji A. Kinsford It is certified that error appears in the above-identified patent and that said Letters Patent is hereby corrected as shown below:

Column 10, line 45 (Claim 7, line 1) please delete “chambers” and insert therefor --chamber--.

Signed and Sealed this
Twenty-ninth Day of November, 2011

David J. Kappos

David J. Kappos
*Director of the United States Patent and Trademark Office*